US006220620B1

(12) United States Patent
Harroun

(10) Patent No.: US 6,220,620 B1
(45) Date of Patent: Apr. 24, 2001

(54) WHEELED HEIGHT-ADJUSTABLE REHABILITATION CHAIR

(76) Inventor: Mary M. Harroun, c/o Merry Walker Corpoartion, 11475 Commercial Ave. STE 9, P.O. Box P, Richmond, IL (US) 60071

( * ) Notice: Subject to any disclaimer, the term of this patent is extended or adjusted under 35 U.S.C. 154(b) by 0 days.

(21) Appl. No.: 09/249,380

(22) Filed: Feb. 21, 1999

(51) Int. Cl.[7] ..... A61G 5/00; A61H 3/04

(52) U.S. Cl. ..... 280/650; 280/81.02; 297/5; 297/DIG. 4

(58) Field of Search ..... 280/87.021, 87.041, 280/87.051, 47.25, 47.4, 47.34, 647, 650, 47.38, 304.1; 297/DIG. 4, 5, 6; 180/907

(56) References Cited

U.S. PATENT DOCUMENTS

| | | | | |
|---|---|---|---|---|
| D. 326,437 | * | 5/1992 | Kuhl et al. | 280/47.4 |
| 2,308,626 | * | 1/1943 | Reinholz | 280/87.051 |
| 2,609,862 | * | 9/1952 | Pratt | 297/DIG. 4 |
| 2,798,533 | * | 7/1957 | Frank | 297/6 |
| 3,083,050 | * | 3/1963 | Gill | 297/DIG. 4 |
| 3,354,893 | * | 11/1967 | Schmerl | 297/6 |
| 4,015,853 | * | 4/1977 | Summers | 280/87.051 |
| 4,625,984 | * | 12/1986 | Kitrell | 297/DIG. 4 |
| 4,759,562 | * | 7/1988 | Vinyard et al. | 297/DIG. 4 |
| 4,890,853 | * | 1/1990 | Olson | 297/DIG. 4 |
| 5,058,912 | | 10/1991 | Harroun | 280/87.021 |
| 5,060,967 | * | 10/1991 | Hulterstrum | 280/650 |
| 5,083,806 | | 1/1992 | Brown | 280/87.05 |
| 5,380,262 | * | 1/1995 | Austin | 280/647 |
| 5,427,438 | * | 6/1995 | Fochs | 297/DIG. 4 |
| 5,466,111 | * | 11/1995 | Meyer | 297/DIG. 4 |
| 5,664,266 | * | 9/1997 | Williams et al. | 297/DIG. 4 |
| 5,701,968 | * | 12/1997 | Wright-Ott et al. | 280/650 |
| 5,741,020 | | 4/1998 | Harroun | 280/42 |

* cited by examiner

*Primary Examiner*—J. J. Swann
*Assistant Examiner*—Christopher Bottorff

(57) ABSTRACT

A rehabilitation chair comprises upper frame, lower and intermediate frames. The upper frame has a seat, side frames with arm assemblies, a pivotable front cross-arm and a back, while the intermediate frame includes a height adjustment unit and the lower frame includes legs and wheels. The wheels are located outboard of the seat to enhance stability, while the legs are positioned to provide a free space for the user's legs to facilitate user propulsion of the chair when the user is either in a standing or seated position. The seat of the chair is of narrow depth, allowing freedom of leg motion when the user is seated.

10 Claims, 3 Drawing Sheets

WHEELED HEIGHT-ADJUSTABLE REHABILITATION CHAIR

FIELD OF THE INVENTION

The present invention relates to a new and improved wheeled, adjustable rehabilitation chair for providing elderly and/or disabled persons with a safe, supportive, seated system on wheels to encourage self-rehabilitation of lower extremities, enabling these elderly and/or disabled persons the opportunity for positive physical outcomes. The wheeled, adjustable rehabilitation chair will provide the first step in providing rehabilitation to proceed from the use of a standard wheel-chair or geri-chair to realizing independent self ambulation by restoring atrophied muscles to functional use.

DESCRIPTION OF THE PRIOR ART

Geri-chairs have been utilized in the care of the elderly and/or disabled persons in long term care facilities. Such chairs offer a deep seat, typically on the order of 21 inches, with a full upholstered back, foot rest, and a front tray to secure the elderly and/or disabled person to the chair. The use of the geri-chair prohibits the elderly and/or disabled person from self mobility by retarding the possibility of restoration of physical function that certain elderly and/or disabled person strongly desire and physically need.

Wheel chairs have been used by elderly and/or disabled persons both for sitting and being moved by an attendant and for self propelling by paddling with the occupant's feet. Wheel chairs were not designed to assist a person to walk or stand, and thus they do not offer the option of assisting the occupant in restoration of self ambulation. Moreover, wheel chairs do not afford sufficient safety systems to prevent an occupant from sliding or slipping out of the seat onto the floor or to prevent an occupant from falling forwardly out of the wheel chair. The utilization of the wheel chair for the elderly and/or disabled does not encourage the movement of lower extremities because the seat of 18 to 20 inches depth provided by the wheel chair is too deep, thus restricting the free movement of the thigh.

Combination chair/walkers, such as disclosed in U.S. Pat. Nos. 5,058,912 and 5,741,020 have been invented, developed and placed on the market that afford the elderly and/or disabled persons the freedom to walk independently within a safe framework. When the occupant gets tired, the provided seat allows the occupant to sit down when desired. Such combination chair/walkers do not encourage the occupant lower extremity movement from a seated position because the design of the combination chair/walker is made for walking, offering a 13 inch walking space, with the seat behind that space. As a result of the foregoing, many elderly and/or disabled persons have experienced muscle tone breakdown over the period of time that they have been placed in geri-chairs and wheel chairs.

OBJECTS OF THE INVENTION

It is an object of the present invention to provide a new wheeled, height-adjustable rehabilitation chair that is sized and constructed to enhance self lower extremity ambulation.

It is a further object of the present invention to provide a new wheeled, height-adjustable rehabilitation chair for utilization by elderly and/or disabled persons which is adjustable for a wide range of occupants, including from four feet eight inches in height to occupants six feet six inches in height and weighing eighty pounds to four hundred pounds.

It is yet another object of the present invention to provide a new wheeled, height-adjustable rehabilitation chair for use by elderly and/or disabled persons with a frontal cross-arm on the rehabilitation chair having a handled, locking latch and a hinge attachment to hold the cross-arm, allowing the cross-arm to open and close, allowing egress and ingress by the occupant. The cross-arm can fully open, wherein the occupant is able to place the unit adjacent to a dining table in order to eat meals or participate in table top activities without having to be transferred to another chair.

It is still another object of the present invention to provide a new wheeled, height-adjustable rehabilitation chair with a front cross-arm, such that when the cross arm is in the closed position on the unit, the occupant will be able to place his or her hands on the cross-arm and provide an isometric pulling motion against the cross-arm that will allow the occupant easier means to move his or her legs across the floor.

It is a still further object of the present invention to provide an attached frontal safety strap to be attached under the seat. After the occupant is placed in the unit the safety strap end may be attached over the front cross-arm to keep the safety strap in place and preventing the occupant from slipping under the cross-arm to fall to the floor.

Yet another object of the wheeled, height-adjustable rehabilitation chair of the present invention is to provide a headrest allowing for head support for the occupant.

Still another object of the invention is to provide a wheeled, height-adjustable rehabilitation chair having multiple legs under the seat, with a pneumatic lift to provide support for the seat in which the occupant is sitting when in use. The legs under the seat are spaced far enough apart so that the occupant will have enough space between the legs to allow for free range of leg motion as in walking from a seated position.

Yet another object of the wheeled, adjustable rehabilitation chair of the invention is to provide rollers or casters on the end of each leg to allow a smooth gliding movement across the floor or other flat surface. A braking mechanism is provided to stop the forward or backward movement of the unit across the floor or flat surface when desired, such as to allow nursing home staff to transfer the elderly and/or disabled persons into the rehabilitation chair.

A further object of the present invention is to provide a seat for the unit which is constructed in a manner which decreases the potential for the occupant of the unit to development pressure point sores and is completely washable.

BRIEF SUMMARY OF THE INVENTION

The foregoing and other objects and advantages of the present invention are accomplished in a new and improved wheeled, height-adjustable rehabilitation chair of the character described, especially designed for aiding the mobility of seated disabled and or/elderly persons, the chair being capable of providing the correct height size for each and every individual needing the assistance it provides to maximize the rehabilitation benefits from the use of this device. The wheeled, height-adjustable rehabilitation chair is fabricated out of metal, and preferably includes upper tubular steel framework having a pair of side frames to support the seat and back. An adjustable pneumatic lift couples the upper frame to a lower frame comprising legs having rollers, casters, or other movement-facility means at the end of each leg. A gated front cross-arm, pivotally hinged on a first side and connected to the other side by a latch closure, extends across the front of the upper frame. The latch secures the cross-arm to the unit when a disabled and or elderly person is placed in the unit. The cross-arm is preferably pivotal about a vertical axis, allowing the wheeled, height-adjustable, rehabilitation chair, when the cross bar is opened, to be positioned closely to a table or the like so that the occupant of the unit is able to eat meals with minimal assistance from care givers. When open, the cross-arm also provides a means of ingress to and egress from the chair.

Rollers or casters are provided on each of the legs for easy movement of the height-adjustable, wheeled rehabilitation chair over a floor or other flat surface. Foot-activated pedal type brake means for activation by a care provider retain the wheeled adjustable rehabilitation chair in a stationary position when desired. The seat of the chair extends forwardly of rear legs, is of shallow depth, and has a forward edge rearwardly of the extent of the front legs, providing for extreme stability. Each side frame may include an upper arm-supporting side rail extending between front and rear portions, forming a portion of an arm-enclosing safety framework for surrounding the occupant while seated. The safety framework further includes a back extending upwardly of the seat at the rear of the frame which may be covered with a slip-on fabric assembly, removably secured at the bottom of the back frame, allowing the cover to be easily removed for laundering. The side frame may also have arm rests provided for user comfort. The upward extending portion of the back has a head rest pillow attached thereto to be used by the occupant when head rest is desired. The pillow may be integral with the fabric assembly.

A side of the wheeled, height-adjustable rehabilitation chair also may support a side pouch for the elderly and/or disabled person to place personal objects such as facial tissue, letters, eye glasses, etc. to carry with the end user while walking from the seated position.

In the open position, the cross-bar pivotally extends outwardly from the side rail, affording an occupant easy ingress and egress to and from the interior of the safety frame and permitting a person to open the cross-arm and be placed at a table in which to eat or other table top activities. When the frontal cross-bar is closed and locked, support is provided for the occupant's hands and arms and the cross-bar may be used to assist the user to propel the wheeled adjustable rehabilitation chair in a sideward, forward or rearward direction when the occupant is seated in the seat. Also, the frontal cross-bar positively secures in a closed position the front end portions of the chair.

The occupant, when seated in the present invention, has free movement of thigh, knee, leg, ankle and foot because the frontal part of the seat stops at the occupant's mid-thigh, thus enabling free movement of the lower extremities. The free movement of the lower extremities encourages mobility, allowing the occupant to receive the benefits by reducing muscle atrophy of the legs and encouraging the occupant to possibly return some level of functional mobility. The front cross-arm enables elderly and/or disabled persons to pull against the front cross-arm to assist in rebuilding upper body strength that may have atrophied due to nonuse while sitting in a geri-chair or wheel chair.

BRIEF DESCRIPTION OF THE DRAWINGS

For a better understanding of the present invention, reference should be had to the following detailed description taken in conjunction with the annexed drawings in which.

DETAILED DESCRIPTION OF A PREFERRED EMBODIMENT OF THE INVENTION

Figure 2:
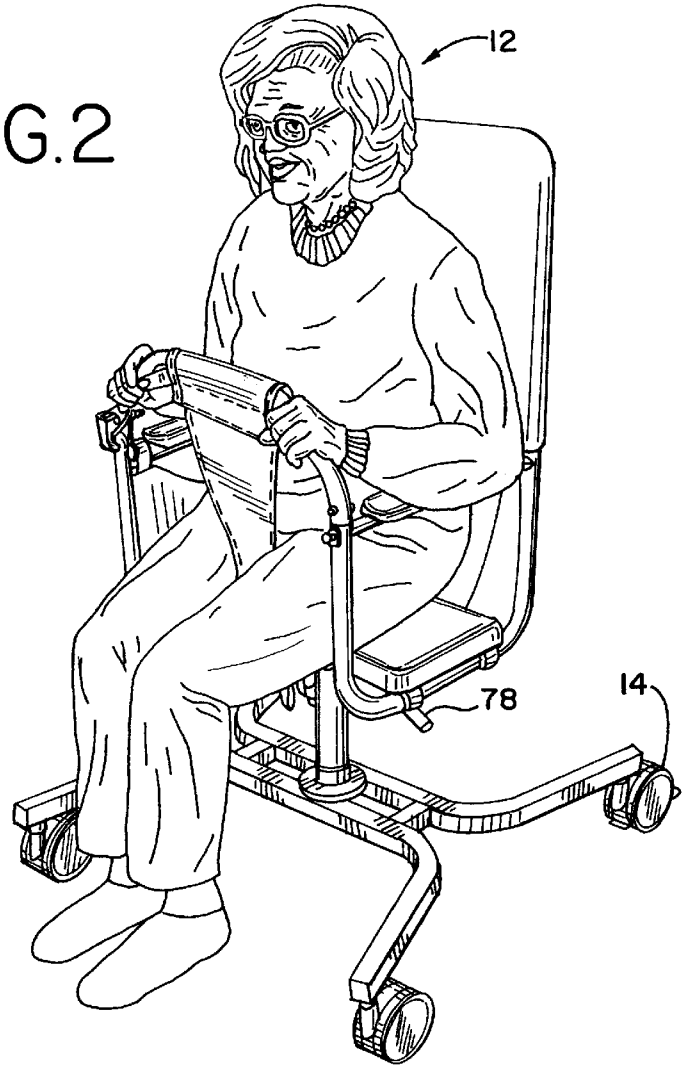
FIG. 2 is a perspective front view of the new and improved wheeled, height adjustable rehabilitation chair constructed in accordance with the features of the present invention in use with an occupant in a sitting position.

Referring now more particularly to the drawings, therein is illustrated a new wheeled, height-adjustable rehabilitation chair constructed in accordance with the features of the present invention and referred to generally by the reference numeral 10. The wheeled, height-adjustable rehabilitation chair 10 is especially designed and useful in affording an elderly and/or disabled person 12 independent leg mobility when used as a seated walker (FIG. 2) with the occupant in a seated position.

When an occupant 12 is seated in the wheeled adjustable rehabilitation chair 10 as shown in FIG. 2, the wheeled adjustable rehabilitation chair may be moved about over a supporting floor or other surface by use of the occupants' feet or legs. The wheeled adjustable rehabilitation chair may also be maintained in a stationary or fixed position when desired by means of brakes 14 provided on one or more of the supporting rollers or casters 16 with the locking mechanism on the brake 14 being activated by foot levers on the brake as described hereinafter. The legs of the occupant are provided with freedom of motion as a result of the wide separation between the forward legs of the chair and the narrow depth of the seat.

Figure 1:
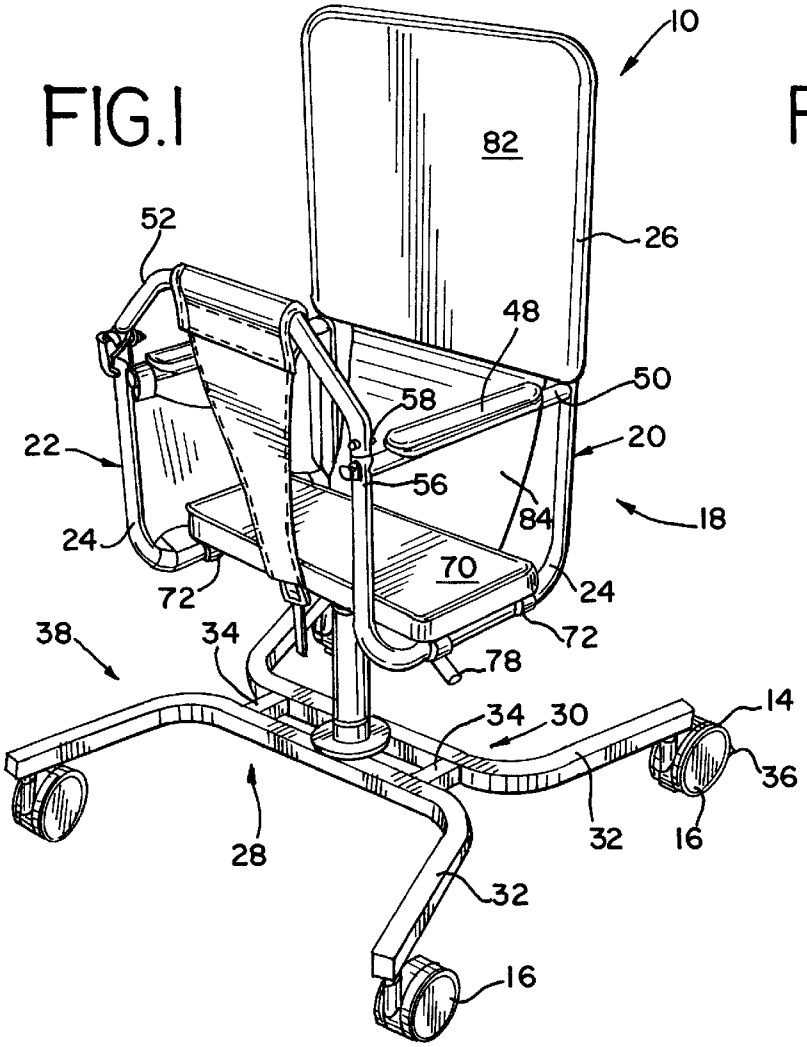
FIG. 1 is a perspective front view of a new and improved wheeled, height adjustable rehabilitation chair constructed in accordance with the features of the present invention.

As seen in FIG. 1, the wheeled, height-adjustable rehabilitation chair 10 includes an upper tubular steel framework 18 employing a pair of identical left and right hand side frame portions 20 and 22. Each side frame portion includes a generally U-shaped side arm frame element 24, the side frame elements 24 being interconnected by inverted U-shaped back support portion 26. Both the side frame portions and back support portion may be formed from a continuous length of tubular stock. A padded arm assembly 48 extends between the forward and rear vertical portions of each of the side frame portions 20, 22 and comprises a tubular steel arm 50, welded or otherwise affixed to vertical portions of the side frame portions, upon which an arm cushion is mounted. The combination of side frame portions 20, 22, back support portion 26, and arm assemblies 48 comprise a rigid, cage-like unit embracing the occupant. A seat 70 is attached to the horizontal portions of side frame portions 20, 22 by seat clips 72, and may also be screwed thereto. The seat 70 is preferably formed of strong, light weight material such as wood, particle board, etc., and is provided on its upper face with a resilient foam covered by an appropriate covering, such as a sheepskin-like fabric or washable heat-sealable vinyl fabric.

As shown, the rehabilitation chair is preferably provided with four casters or rollers 16, mounted as pairs of front and rear casters to front and rear leg assemblies 28, 30, respectively. Each of the leg assemblies is generally U-shaped, with legs 32 which support the casters at their ends. The two leg assemblies 28, 30 are joined together at their central portions by welded stubs 34 to form a lower frame 38. At least two of the casters, placed on the two rear legs 32, have foot-operated brakes thereon provided with toe or foot-operated brake levers 36 for locking the caster wheels or rollers against rotation when it is desired to retain the wheeled adjustable rehabilitation chair in a particular location against forward or backward movement. As known, the brake levers 36 are depressed downwardly to lock the rollers of the two rear casters 16 against rotation, the brakes are releasable by upward movement of the brake levers. The casters 16 are preferably of the swivel type to provide for easy steerability of the wheeled adjustable rehabilitation chair.

Figure 5:
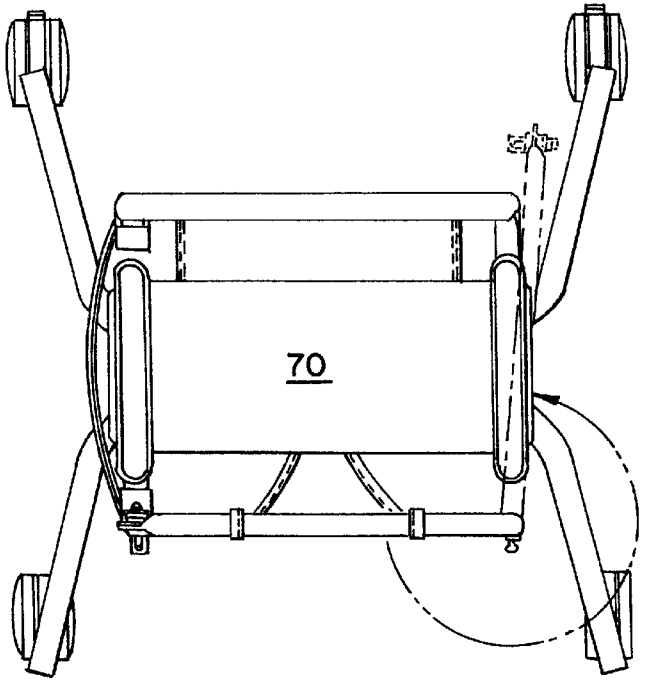
FIG. 5 is a top plan view of the wheeled, height-adjustable rehabilitation chair showing the position of the legs, allowing the occupant ample movement space of the occupant's legs.

To provide enhanced ease of use by the occupant, the legs 32, and particularly the front legs, are spaced sufficiently apart to be outside the range of movement for the occupant's legs. As shown, they may be spaced sufficiently to provide a spacing exceeding the width between the side frame portions 20, 22. The legs also extend forwardly and rearwardly sufficiently to provide increased stability for the chair. As seen in FIG. 5, the casters are both outward of the width of the seat and substantially forward and rearward thereof.

Figure 4:
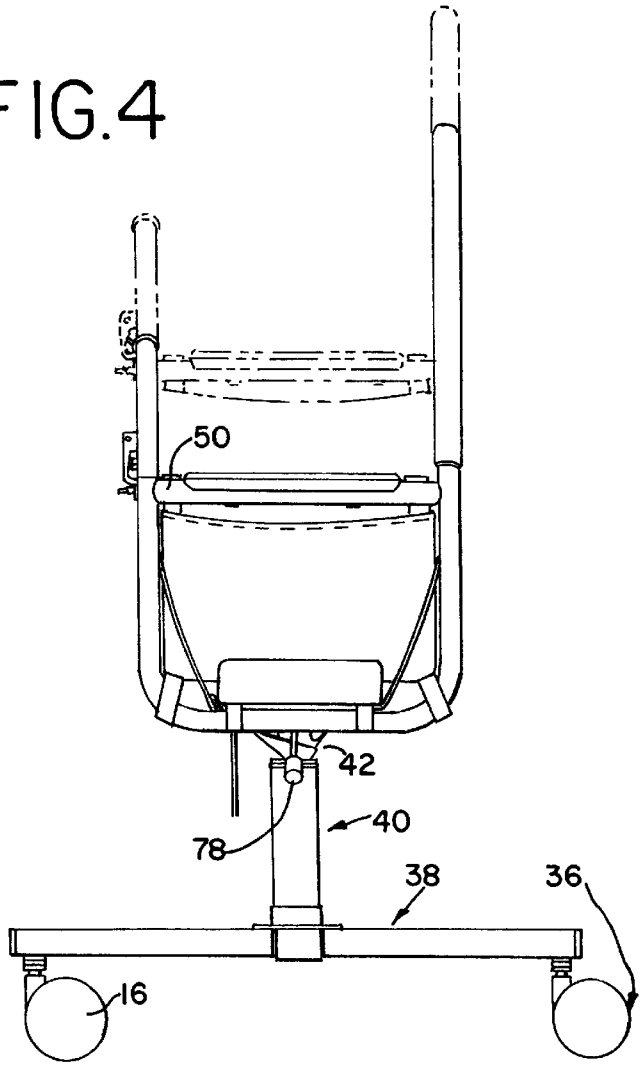
FIG. 4 is a perspective side elevational view of the wheeled adjustable rehabilitation chair, displaying a pneumatic lift in operation lifting the whole body of the chair from a lowered position to a raised position shown in phantom.

In accordance with the invention the upper frame 18 is interconnected to the lower frame 38 by means of short, tubular steel vertical frame 40 having a pneumatic lift 42 with an operating handle 78. The lift 42 is preferably at the upper end of vertical frame 40, and interconnects the vertical frame to upper frame 18 through seat 70. The lower end of vertical frame 40 is mounted to the central portion of lower frame 38. As seen in FIG. 4, the pneumatic lift 42 allows the wheeled adjustable rehabilitation chair to adjust in differing heights to accommodate the differing heights of occupants. Preferably, an operating height range for the seat of from sixteen inches to twenty-six inches in height can afford a wide range of occupants maximum use for rehabilitation by leg movement from a seated position.

Figure 3:
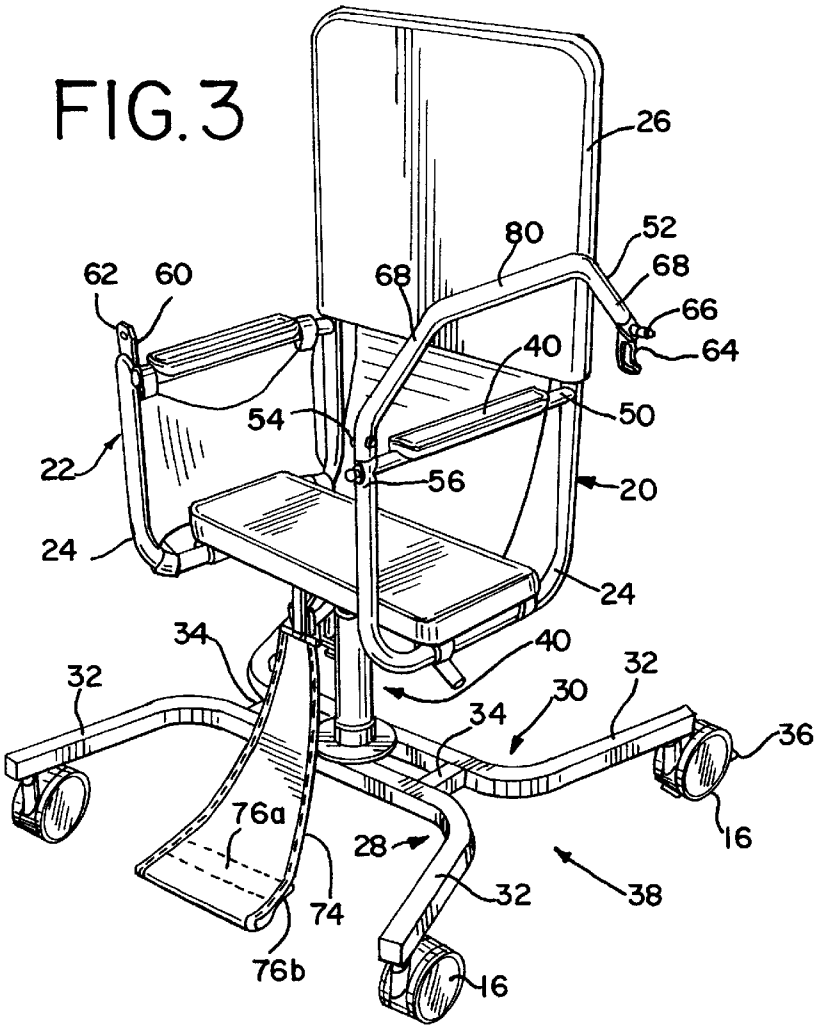
FIG. 3 is a perspective frontal elevational view of the wheeled, height adjustable rehabilitation chair while not in use with the front cross-arm shown in an open position for ingress and egress of an occupant.
Figure 6:
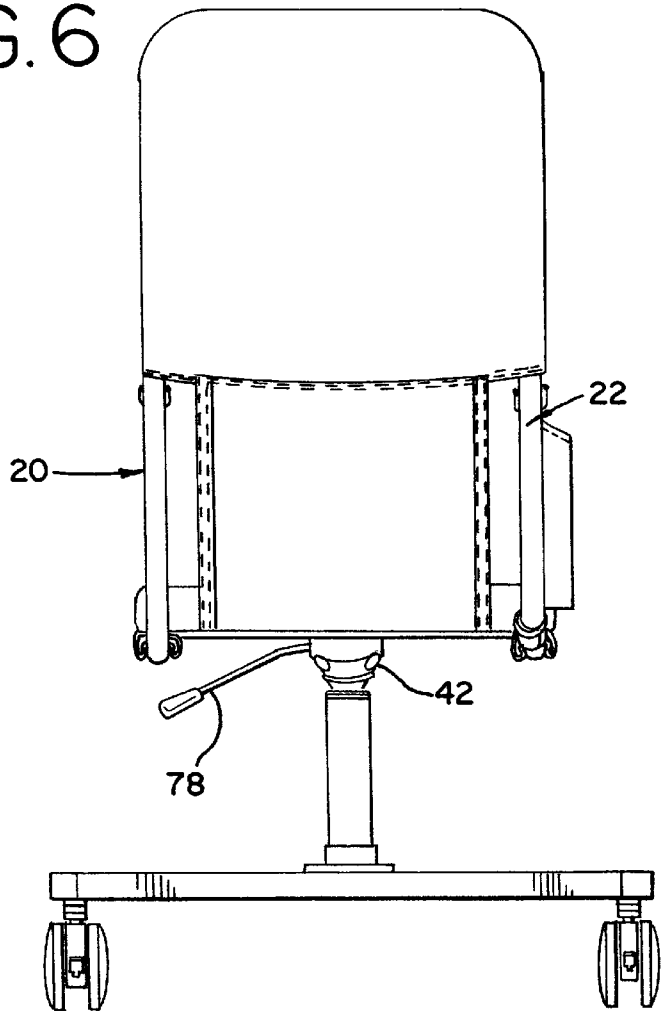
FIG. 6 is a rear elevation view of the wheeled, height-adjustable rehabilitation chair.

To removably retain the occupant 12 in the chair, and to provide a grip surface for the occupant's hands, a front cross-arm 52 is pivotally connected to the left side frame 20 by means of a rotating hinge joint 54. The hinge may be a section of tubing mounted within the interior of the end of the cross arm 52 and dimensioned to fit snugly, but sufficiently loosely to allow rotation within, the corresponding forward end 56 of the side rail 20. The tubing section may be pinned within the cross-arm by pin 58. In FIG. 3 the front cross-arm is detailed showing the pivotal hinge 54 allowing the cross-arm to open about a 270 degree arc from its closed position to permit an occupant complete freedom of ingress and egress from the chair, and allowing the occupant to move up to a dining room table or other table in order to perform dining activities, thus removing the necessity to be transferred from one rehabilitation chair to another dining room chair.

A lock assembly removably retains the free end of the cross arm 52 to the other, right side rail frame 22. As shown, the lock may comprise a bracket 60 mounted to the forward upper end of side rail frame 22 and having a shaped bore 62 therethrough. The free end of cross-arm 52 is provided with a lock handle 64 connected to a shaped lock shaft 66 having a profile which allows its insertion through bore 62 when the cross-arm is pivoted towards the bracket and subsequent retention within the bore when the handle and shaft are rotated upon engagement. Preferably, the cross-arm 52 is of a trapezoidal shape, presenting a central horizontal portion 80 positioned above the upper forward ends of the side rail portions 20, 22 and arm assembles 48, flanked by angled portions 68. The angled portions provide comfortable hand grips for the occupant, as shown in FIG. 2, assisting the occupant in guiding the chair with foot motion.

The seat 70 is of relatively narrow depth, on the order of 12 inches, and is positioned directly over vertical framework 40 for stability. A strap 74 is affixed to the lower front edge of the seat, its free end being adapted to engage the cross-arm 52 when in the closed position, assisting in restraining the occupant in the seat and preventing the occupant from sliding forward and down, out of the seat. The free end of the strap may be provided with adjacent sections 76*a,b* of complementary hook and loop material, allowing the free end to be wrapped around the cross-arm and closed upon itself as depicted in FIG. 2. The narrow seat depth allows support of the buttocks while allowing freedom from mid-thigh downward to facilitate leg action. It also maximizes the enclosed area, facilitating standing and walking when the occupant rises from the chair.

The back of the chair is covered in washable fabric 82 which is slid over the top of the back support frame and moved down the vertical sides thereof into position, the bottom end of the cover being located proximate the connection between the arms 50 and the side frame portion. A wide strap 84 connects the lower end of the cover to the bottom rear of the seat, and may be provided with hook and loop fasteners to allow the cover to be removed as needed. A pillow (not shown) may be affixed to the upper portion of the back cover.

The rehabilitation chair of the present invention provides a stable platform for support of an occupant while sitting, while permitting the occupant to use foot action to propel his or herself in he sitting position, also providing a safety, cage-like enclosure to assist the occupant in walking or standing. Those skilled in the art will recognize that modifications and variations from the embodiment set forth herein may be accomplished without departing from the intended scope of the invention, as set forth in the annexed claims.

I claim:

1. A rehabilitation chair comprising an upper frame having a seat, side frames having arm assemblies on opposed sides of the seat, a front cross-arm having a central horizontal portion extending longitudinally between the opposed sides of the seat at a vertical position above the level of the arm assemblies and a pair of depending angled handgrip side portions pivotable between a closed position between said side frames and an open position, and a back spaced from the seat located above and rearwardly of a rear edge of the seat; a lower frame comprising a pair of leg members, a front one of said leg members forming an open U-shaped frame with an open mouth free of inward projections within which the legs of a user can be positioned when the user is sitting in the chair to permit a walking leg motion without interference with the leg members, each having a pair of wheels at distal ends thereof; and an intermediate frame positioned centrally with respect to said seat interconnecting the upper and lower frames, and said intermediate frame including height adjustment means for varying the height of the upper frame with respect to the lower frame.

2. The rehabilitation chair of claim 1, wherein said leg members have distal ends outboard of said seat.

3. The rehabilitation chair of claim 1, wherein the front cross arm is in the form of a trapezoid.

4. The rehabilitation chair of claim 3, wherein the front cross-arm has a horizontal portion above the arm assemblies of the side frames.

5. The rehabilitation chair of claim 3 further including a releasable restraining strap extending between a forward edge of the seat and the front cross-arm.

6. The rehabilitation chair of claim 3, wherein said front cross-arm is pivotable in a horizontal plane.

7. The rehabilitation chair of claim 6 further comprising releasable lock means mounted to said front cross-arm and one of said side frames to retain the cross-arm in the closed position.

8. The rehabilitation chair of claim 1, wherein said side frames and back comprise portions of a unitary framing element.

9. The rehabilitation chair of claim 1, wherein the seat of a user is of a depth chosen to support the buttocks of a user with the legs of the user beyond mid-thigh region being free of seat support.

10. The rehabilitation chair of claim 3, wherein said cross-arm is located at a height to serve as a grip for the user for upper body exercise.

* * * * *